United States Patent [19]

Matsumoto et al.

[11] Patent Number: 4,559,519

[45] Date of Patent: Dec. 17, 1985

[54] DISPLAY DEVICE FOR A COPYING MACHINE

[75] Inventors: Hiroshi Matsumoto, Yokohama; Yuji Ishikawa, Machida; Chosin Nakamine, Yokohama, all of Japan

[73] Assignee: Tokyo Shibaura Denki Kabushiki Kaisha, Kanagawa, Japan

[21] Appl. No.: 345,547

[22] Filed: Feb. 3, 1982

[30] Foreign Application Priority Data

Feb. 24, 1981 [JP] Japan ..... 56-25659

[51] Int. Cl.[4] ..... G09G 3/00

[52] U.S. Cl. ..... 340/286 M; 340/525; 340/715; 340/784

[58] Field of Search ..... 340/286 M, 524, 525, 340/675–679, 715, 765, 784, 752, 756, 52 R, 52 D, 52 F; 343/3 SH; 73/432 AD

[56] References Cited

U.S. PATENT DOCUMENTS

| | | | |
|---|---|---|---|
| 2,902,681 | 9/1959 | Dietert et al. | 340/525 |
| 3,803,580 | 4/1974 | Shattuck | 340/286 M |
| 4,173,757 | 11/1979 | Hareng et al. | 340/815.07 |
| 4,176,941 | 12/1979 | Breitenkam . | |
| 4,186,376 | 1/1980 | Uchida | 340/525 |
| 4,224,615 | 9/1980 | Penz | 340/712 |
| 4,295,136 | 10/1981 | Stoutenburg | 340/753 |

*Primary Examiner*—Marshall M. Curtis

*Attorney, Agent, or Firm*—Banner, Birch, McKie & Beckett

[57] ABSTRACT

A display device according to the present invention is incorporated into an electrical machine in order to display the operating condition of the electrical machine. The electrical machine has movable parts such as doors to be opened by an operator when the electrical machine stops operating due to a malfunction. This display device schematically shows, by means of display elements, the positions of the movable parts before and after the operator moves them, and displays the elements in accordance with the condition of the electrical machine. Upon the occurrence of a malfunction in the electrical machine, the display elements on the schematic display corresponding to the faulty machine part can be displayed so as to be understood by the operator.

6 Claims, 17 Drawing Figures

DISPLAY DEVICE FOR A COPYING MACHINE

BACKGROUND OF THE INVENTION

This invention relates to a display device for displaying operating conditions of an electrical machine such as an electrophotographic copying machine. These machines, which transport a medium such as paper, are required to transport the medium at high speed to increase the treatment speed. However, the higher the transporting speed, the greater is the incidence of jamming of the transported medium in the transportation path. When jamming occurs, this electrical machine stops transportation of all of the transported medium behind the jammed one, and at the same time stops all the functions of the electrical machine. In this case, it is necessary for the operator to take out the jammed medium to remove the cause of the fault in order to quickly regain the operation of the electrical machine. Therefore, it is most important for the operator to detect the cause of the fault. To meet this demand, as shown in U.S. Pat. No. 4,176,941, it has been made possible for the operator to detect the faulty part by means of a device displaying a schematic representation of the electrophotographic machine and also displaying on the schematic the location of the jam (in case paper jamming occurs) or other fault.

However, though it is made possible for the operator to detect the faulty part on this displaying device, it is difficult for the unskilled operator (i.e., one who is not a key-operator) to understand how to remedy the fault.

Since the faulty condition continues for many hours unless it is corrected by an experienced operator (i.e., a key-operator) trained in the repair procedure, the prior art display device is inconvenient, since the electrical machine must be easily operated by anyone in the office.

SUMMARY OF THE INVENTION

One object of this invention is to provide a display device on an electrical machine, such as an electrophotographic copying machine having movable parts able to be operated by an operator, for accurately displaying the condition of the machine.

Another object of the invention is to provide a display device which makes it easy for even unskilled operators to properly carry out the repair work in case of a malfunction of the electrical machine.

A further object of the invention is to provide a compact display device.

The display device according to the present invention is incorporated into an electrical machine in order to display the operating condition of the electrical machine. The electrical machine has movable parts, such as doors, to be opened from outside by an operator when the electrical machine stops operating due to a malfunction. This display device schematically shows, by means of display elements, the positions of the movable parts either before or after the operator moves them, depending upon the malfunction or condition being displayed, and displays the elements in accordance with the condition of the electrical machine. Upon the occurrence of a malfunction in the electrical machine, the display elements, corresponding to the faulty machine component part, can be displayed so as to be understood by the operator.

In this display device, in case of malfunction of the electrical machine requiring an operator to move one or more of the moving parts, the electrical display elements are activated to show, schematically, the positions in which moving parts should be after they have been moved.

Therefore, in case the operator of the electric machine is unskilled and not trained in the repair procedure, the operator, by looking at this display device, can instantly understand which moving part of the electrical machine to move and in which direction to move it, upon the occurrence of a malfunction. The invention is especially useful when the electrical machine, such as an electrophotographic copying machine, is to be operated not only by a special operator but also by anyone in the office. Other objects and features of this invention will be apparent from the following description read in connection with the accompanying drawings.

BRIEF DESCRIPTION OF THE DRAWINGS

FIG. 4 is a signal wave form diagram showing the process by which the display control circuit of FIG. 3 indicates that the copying machine is able to copy after the power switch has been turned on.

DETAILED DESCRIPTION OF THE PREFERRED EMBODIMENT

Figure 1:
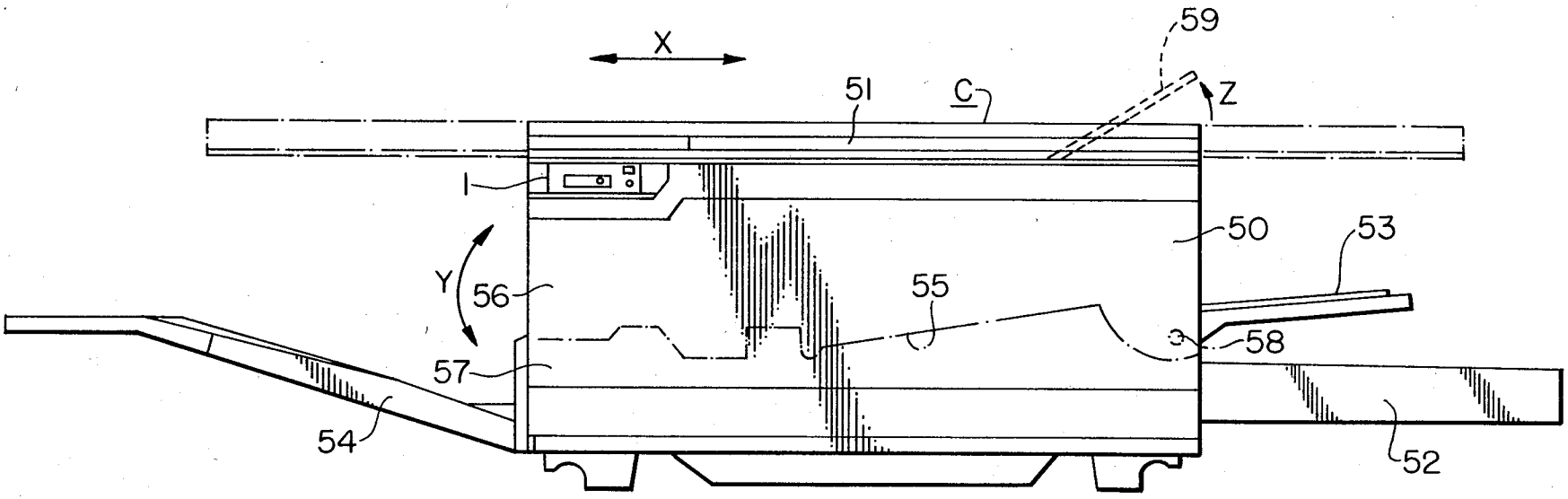
FIG. 1 is an elevational view of a copying machine utilizing a display device according to the present invention.

FIG. 1 shows an electrophotographic copying machine C. As shown at the upper left, a display device 1 is positioned on the surface of the casing 50. In this copying machine C, an original-carrier 51, mounted with an original (not shown), is designed freely to reciprocate in the X directions by a drive mechanism (not shown). The original is then illuminated by an illumination system (not shown) and the reflected light forms an electrostatic latent image of the original on the surface of a photosensitive member (not shown). In the meantime, a single sheet of paper is removed from a cassette 52 or guided on a manual feed tray 53, and is transported to the photosensitive member. The electrostatic latent image on the photosensitive member is developed by the toner in a developer unit (not shown). The developed image is then transferred onto the paper by a transfer mechanism (not shown). The paper is then guided to a fusing mechanism (not shown) and thereafter discharged onto a tray 54. The casing 50 is constructed of two covers, an upper cover 56 and a lower cover 57. The upper cover 56 can be raised or lowered in the directions of arrow Y, pivoting about a hinge point 58. The upper cover 56 and lower cover 57 are separated along line 55. Therefore, paper can easily be removed if it becomes jammed along the transportation passage in casing 50. A part 59 indicated with a dotted line is a top cover for covering a toner hopper (not shown) in casing 50. If the original-carrier 51 is moved to the left, the operator can swing top cover 59 in the direction of arrow Z and can replenish the toner in the toner hopper through the gap between upper cover 56 and top cover 59.

Figure 2:
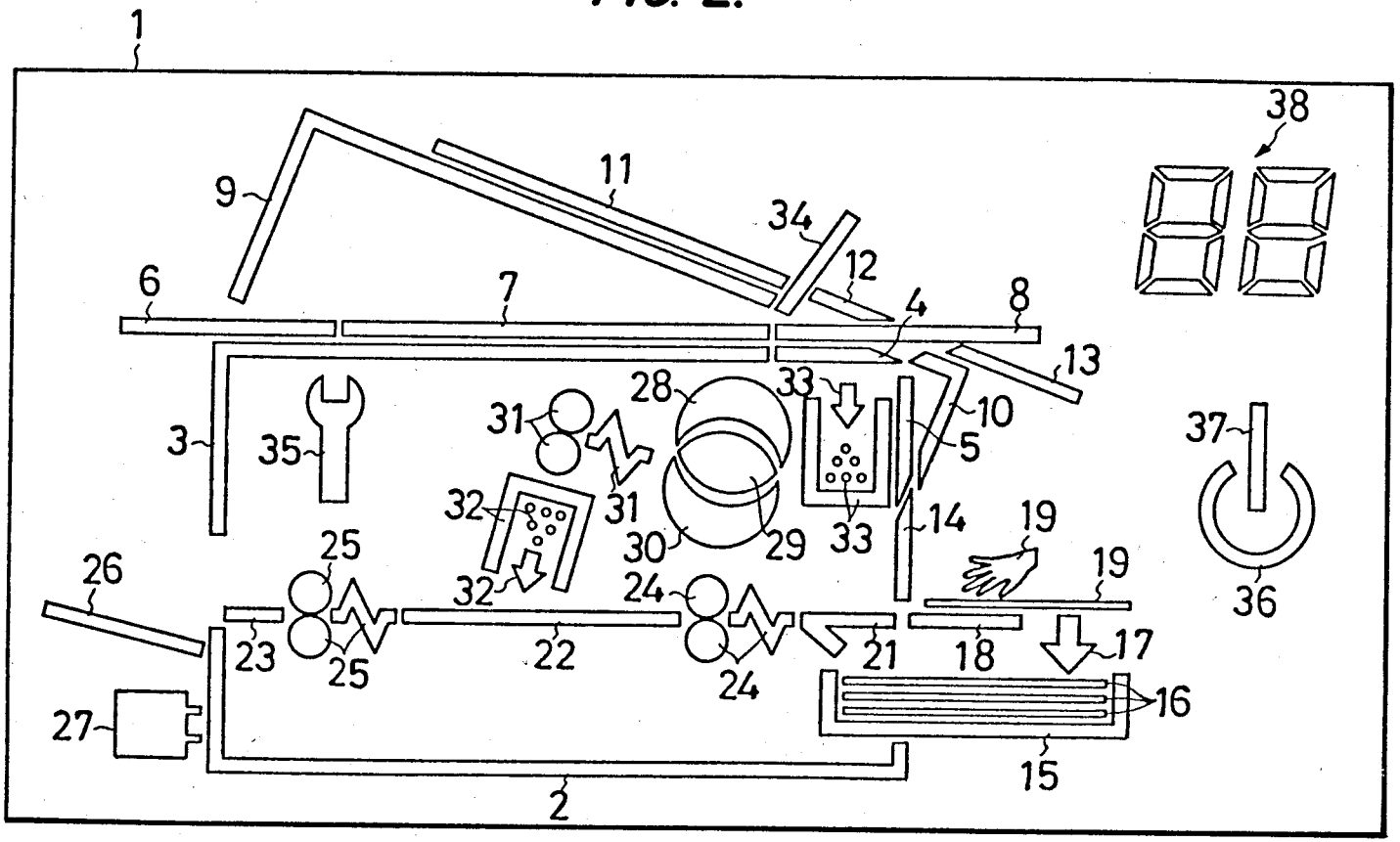
FIG. 2 is a drawing of the display device of this invention.

FIG. 2 shows in greater detail the display device 1 of copying machine C in FIG. 1. Display segments are shown, by means of which the component parts and moving parts of the copying machine can be schematically described with liquid crystal elements. In this drawing, display device 1 is a liquid crystal display panel; 2 is the lower cover display segment for displaying lower cover 57 in FIG. 1; 3, 4 and 5 are upper cover display segments for displaying upper cover 56 in its closed condition; 6, 7 and 8 are original-carrier display segments which are displayed along with the closed upper cover display; 9 and 10 are upper cover display segments for displaying upper cover 56 in its opened condition; 11, 12 and 13 are original-carrier display segments which are displayed along with the opened upper cover display; 14 is a segment for displaying hinge 58 of upper cover 56; 15 is a segment for displaying paper feed cassette 52; 16 is a segment for displaying the copying paper in paper feed cassette 52; 17 is an arrow indicating the absence of copying paper; 18 is a segment for displaying manual paper feed tray 53; 19 is a segment indicating that the copying machine shown in FIG. 1 is in the manual paper feeding mode.

Furthermore, 21, 22 and 23 are segments for displaying the transport passage through which the copying paper passes; 24 is a segment for indicating the occurence of paper jamming in the transport passage; 25 is a segment for indicating the occurence of paper jamming in the fuser or paper discharge section; 26 is a segment for displaying discharge tray 54; 27 is a segment indicating to the operator that he should connect a key counter to count the number of copies; 28, 29 and 30 are segments for indicating the photosensitive drum on which the electrostatic latent image is formed; 31 is a segment for indicating paper separation from the photosensitive drum; 32 is a segment for indicating that the recovered-toner storage bin is filled up with the recovered toner; 33 is a segment for indicating that the toner hopper of the developing unit is empty; 34 is a segment for displaying the top cover 59, indicating to the operator to supply toner by opening the cover 59. Still further, 35 is a segment for indicating the necessity of a periodical check on, for example, the replacement of consumables (filter, photosensitive drum and heat-roller); 36 and 37 are segments for indicating the machine's ability to copy (the "ready" condition). Segment 36 alone indicates that copying machine C is able to copy, and both segments 36 and 37 indicate that copying machine C is unable to copy. 38 is a pair of seven-segment numeral displays for indicating the number of copies. On the face of the aforementioned segments, a common electrode is provided, although not shown in the figure.

Figure 3:
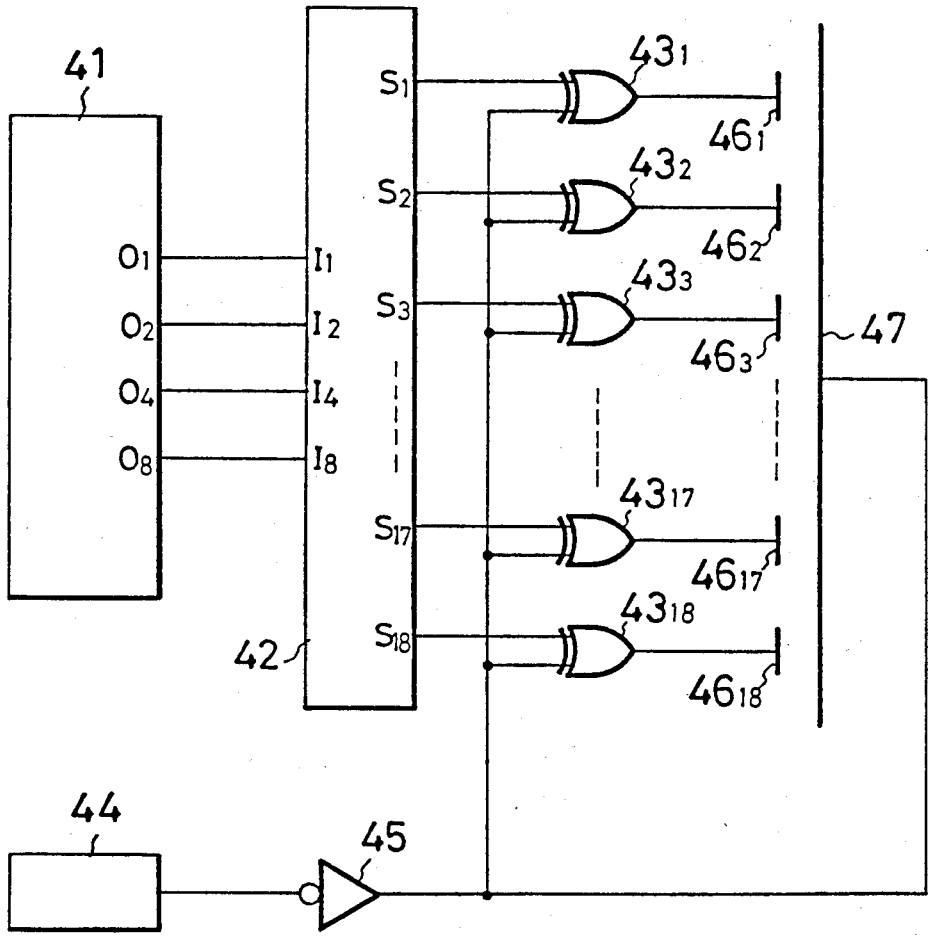
FIG. 3 is a block diagram of a display control circuit to activate the display device shown in FIG. 2.

FIG. 3 is a display control circuit for lighting the display segments shown in FIG. 2. Main control 41 is a microcomputer which controls copying machine C and outputs the condition of copying machine C in four binary digits through terminals $0_1$, $0_2$, $0_4$ and $0_8$. Main control 41 connects to a decoder circuit 42, and the binary signal from main control 41 is input to input terminas $I_1$, $I_2$, $I_4$, and $I_8$. The signal is decoded as shown in Table 1. The decoded signal (i.e., segment signal) is output through output terminal $S_1$ to $S_{18}$. Table 1 is a truth table explaining the states of output terminals $S_1$ to $S_{18}$ which correspond to the various inputs at input terminals $I_1$, $I_2$, $I_3$, and $I_4$.

TABLE 1

| Decoder Input | | | | Decoder Output | | | | | | | | | | | | | | | | | | |
|---|---|---|---|---|---|---|---|---|---|---|---|---|---|---|---|---|---|---|---|---|---|---|
| $I_8$ | $I_4$ | $I_2$ | $I_1$ | $S_1$ | $S_2$ | $S_3$ | $S_4$ | $S_5$ | $S_6$ | $S_7$ | $S_8$ | $S_9$ | $S_{10}$ | $S_{11}$ | $S_{12}$ | $S_{13}$ | $S_{14}$ | $S_{15}$ | $S_{16}$ | $S_{17}$ | $S_{18}$ | Condition Displayed |
| 0 | 0 | 0 | 1 | 1 | 1 | 1 | 0 | 0 | 0 | 0 | 1 | 1 | 0 | 0 | 0 | 0 | 0 | 0 | 0 | 0 | 1 | standby |
| 0 | 0 | 1 | 0 | 1 | 1 | 1 | 0 | 0 | 0 | 0 | 1 | 1 | 0 | 0 | 0 | 0 | 0 | 0 | 0 | 0 | 0 | ready |
| 0 | 0 | 1 | 1 | 1 | 1 | 1 | 0 | 0 | 0 | 0 | 1 | 0 | 1 | 0 | 0 | 0 | 0 | 0 | 0 | 0 | 1 | absence of copying paper |
| 0 | 1 | 0 | 0 | 1 | 1 | 1 | 0 | 0 | 0 | 0 | 1 | 1 | 0 | 0 | 1 | 0 | 0 | 0 | 0 | 0 | 1 | key counter |
| 0 | 1 | 0 | 1 | 1 | 1 | 0 | 0 | 0 | 0 | 1 | 1 | 1 | 0 | 0 | 0 | 0 | 0 | 1 | 1 | 0 | 0 | no toner |
| 0 | 1 | 1 | 0 | 1 | 0 | 0 | 1 | 0 | 0 | 0 | 1 | 1 | 0 | 0 | 0 | 0 | 1 | 0 | 0 | 0 | 0 | filled with recovered toner |
| 0 | 1 | 1 | 1 | 1 | 1 | 1 | 0 | 0 | 0 | 0 | 0 | 0 | 0 | 1 | 0 | 0 | 0 | 0 | 0 | 0 | 0 | manual paper feed |
| 1 | 0 | 0 | 0 | 1 | 1 | 1 | 0 | 0 | 0 | 0 | 1 | 1 | 0 | 0 | 0 | 0 | 0 | 0 | 0 | 1 | 0 | periodical inspection |
| 1 | 0 | 0 | 1 | 1 | 0 | 0 | 1 | 1 | 0 | 0 | 1 | 1 | 0 | 0 | 0 | 0 | 0 | 0 | 0 | 0 | 1 | paper jamming supply unit |
| 1 | 0 | 1 | 0 | 1 | 0 | 0 | 1 | 0 | 0 | 0 | 1 | 1 | 0 | 0 | 0 | 1 | 0 | 0 | 0 | 0 | 1 | paper separating from drum |
| 1 | 0 | 1 | 1 | 1 | 0 | 0 | 1 | 0 | 1 | 0 | 1 | 1 | 0 | 0 | 0 | 0 | 0 | 0 | 0 | 0 | 1 | paper jamming fuser |

TABLE 1-continued

| Decoder Input | | | | Decoder Output | | | | | | | | | | | | | | | | | | |
|---|---|---|---|---|---|---|---|---|---|---|---|---|---|---|---|---|---|---|---|---|---|---|
| $I_8$ | $I_4$ | $I_2$ | $I_1$ | $S_1$ | $S_2$ | $S_3$ | $S_4$ | $S_5$ | $S_6$ | $S_7$ | $S_8$ | $S_9$ | $S_{10}$ | $S_{11}$ | $S_{12}$ | $S_{13}$ | $S_{14}$ | $S_{15}$ | $S_{16}$ | $S_{17}$ | $S_{18}$ | Condition Displayed |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | copying |

The decoded output signal from each output terminal ($S_1$ to $S_{18}$) of decoder circuit 42 is supplied respectively to an input terminal of exclusive OR circuits $43_1$ to $43_{18}$ (hereinafter referred to as EOR circuits). To the other input terminal of EOR circuits $43_1$ to $43_{18}$ is supplied the output signal from an oscillator 44, via an inverter 45. Oscillator 44 supplies the AC signal for driving the liquid crystal display elements. Each output of EOR circuits $43_1$ to $43_{18}$ is supplied to corresponding circuit segments $46_1$ to $46_{18}$ of the liquid crystal display, and the output of inverter circuit 45 is supplied to the common electrode 47. Each of circuit segments $46_1$ to $46_{18}$ activates one or more of display segments 2–37 as shown in Table 2 below.

TABLE 2

| Circuit segment in FIG. 3 | Display segment of display device 1 in FIG. 2 |
|---|---|
| $46_1$ | 2, 14, 18, 28, 29, 36 |
| $46_2$ | 2, 5, 7, 30 |
| $46_3$ | 4, 8 |
| $46_4$ | 9, 10, 11, 12, 13, 26 |
| $46_5$ | 21, 24 |
| $46_6$ | 22, 23, 25 |
| $46_7$ | 6 |
| $46_8$ | 15 |
| $46_9$ | 16 |
| $46_{10}$ | 17 |
| $46_{11}$ | 19 |
| $46_{12}$ | 27 |
| $46_{13}$ | 31 |
| $46_{14}$ | 32 |
| $46_{15}$ | 33 |
| $46_{16}$ | 34 |
| $46_{17}$ | 35 |
| $46_{18}$ | 37 |

Therefore, only circuit segment $46_1$ to $46_6$, among the circuit segments in FIG. 3, are connected with a plurality of display segments in FIG. 2 as shown clearly in the above Table 2.

Figure 4:
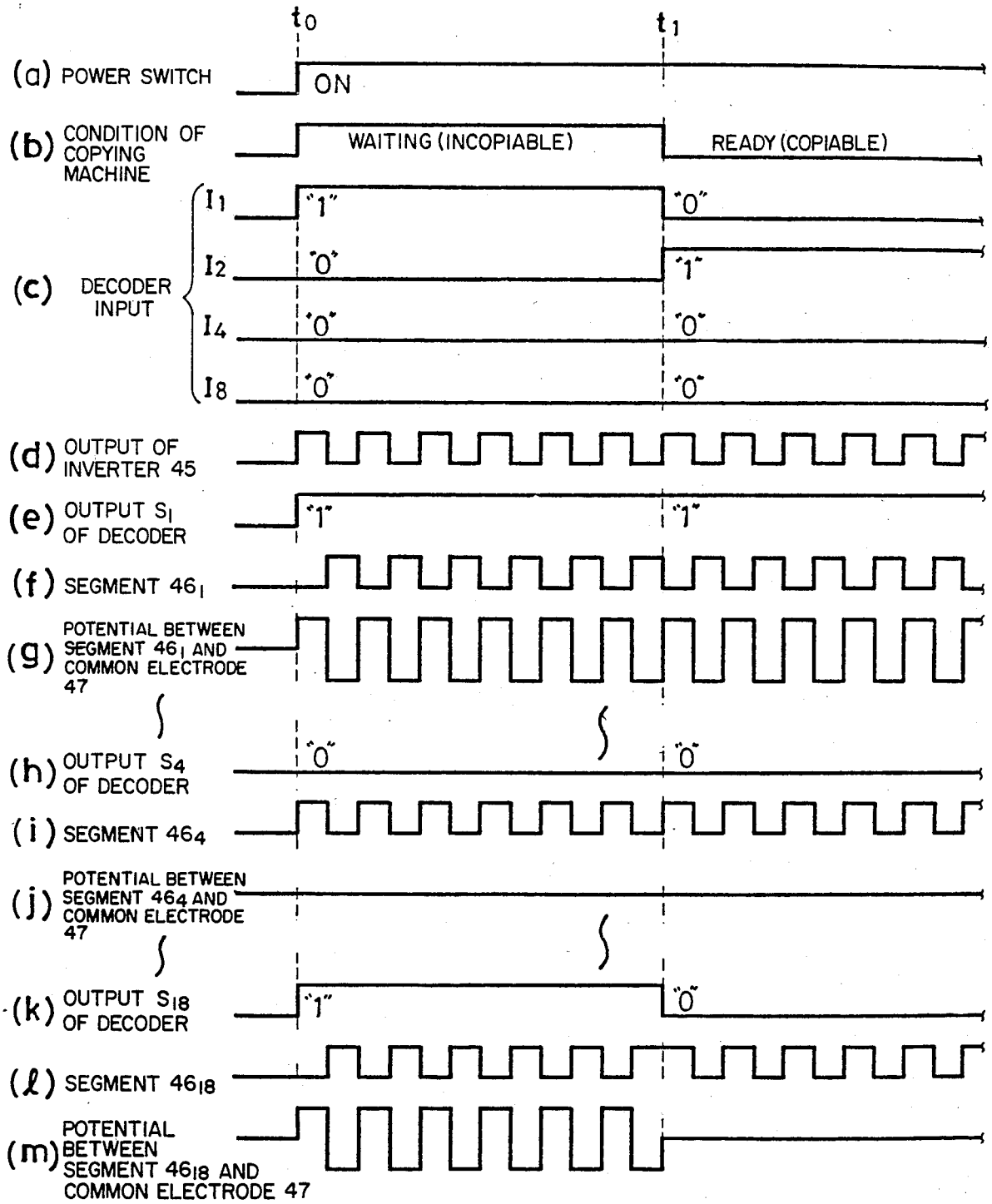
Figure 5:
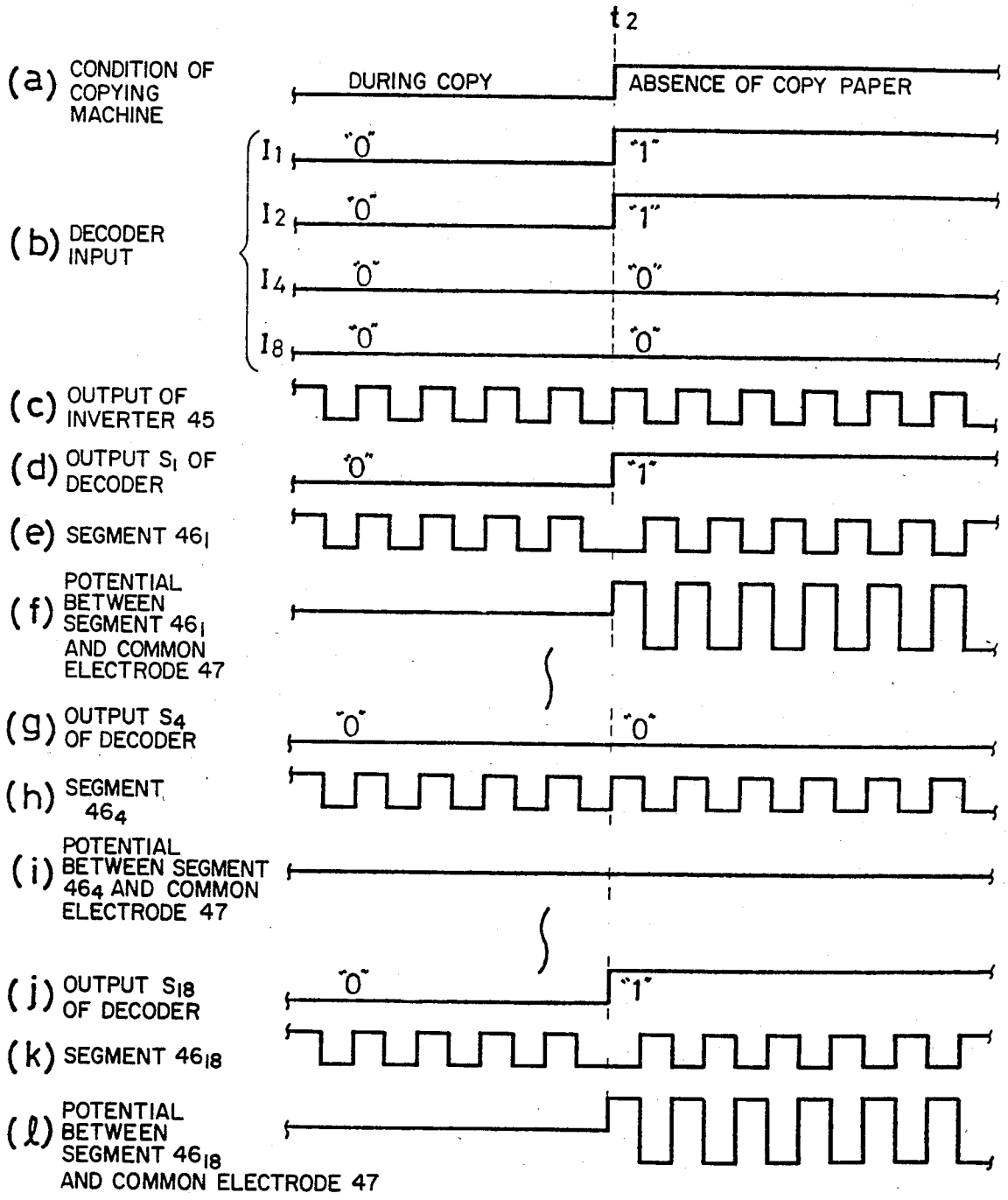
FIG. 5 is a signal wave form diagram showing the result, in the display control circuit of FIG. 3, of copying paper running out during a copying operation.
Figure 6:
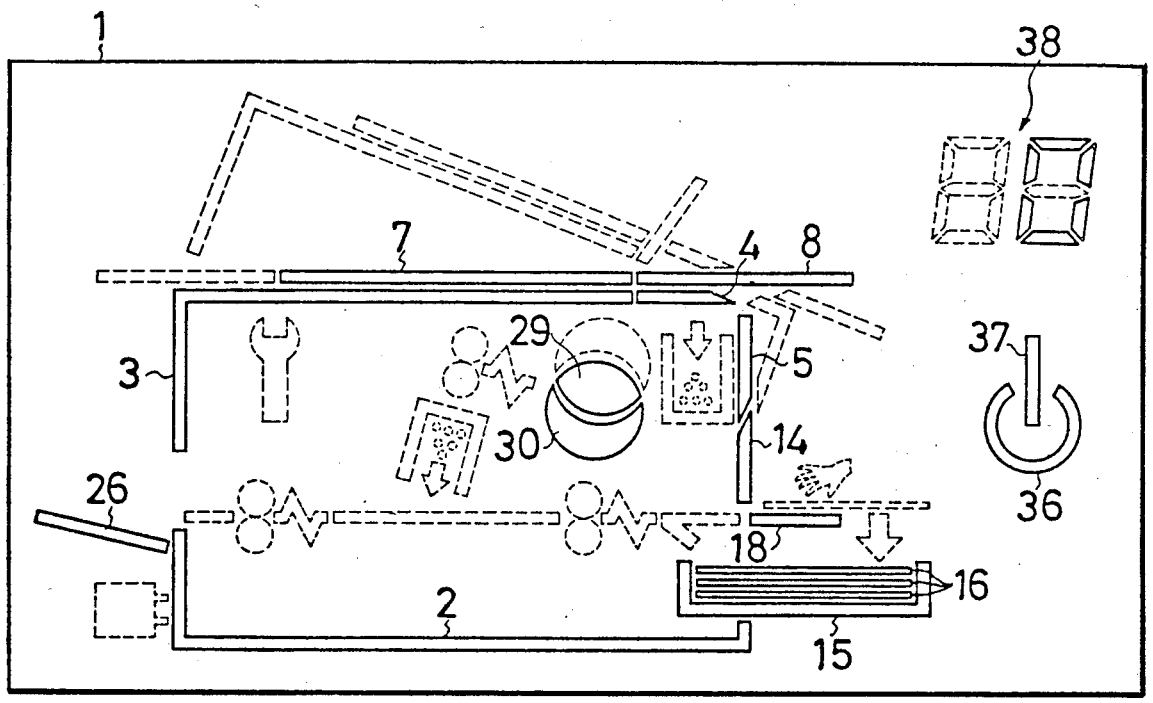
FIG. 6 shows the configuration of the display device of FIG. 2 when the machine is in the standby condition.

There follows a discussion of the operation of the display device, referring to the timing charts in FIG. 4 and FIG. 5. FIG. 4 shows the process by which copying machine C indicates that it is able to copy after the power switch of copying machine C has been turned on. FIG. 5 shows the result of copying paper running out during a copying operation. In FIG. 4, when the power switch is turned on at time $t_o$, main control 41 starts operation according to the program previously programmed and outputs a command for supplying power to the fusing heater. Simultaneously, the main control 41 outputs the code signal "1" (binary 0001) showing the stanby condition (unable to copy) of copying machine C from output terminals $0_1$, $0_2$, $0_4$ and $0_8$, since at this time, the fusing heater has not yet reached operating temperature. This code signal (0001) enters input terminals $I_1$, $I_2$, $I_4$ and $I_8$ of decoder circuit 42. The output terminals $S_1$ to $S_{18}$ of decoder circuit 42 become (111000011000000001) as shown in Table 1. In FIG. 4, the waveforms corresponding to output terminals $S_1$, $S_4$ and $S_8$ of decoder circuit 42 are shown, but those corresponding to the other output terminals $S_2$, $S_3$, $S_5$, $S_{17}$ also can be obtained as shown in Table 1. When the output terminal $S_1$ of decoder circuit 42 is indicating "1," the output signal of EOR circuit $43_1$ is 180° out of phase with the output signal of inverter circuit 45 as shown in FIG. 4(*f*), and is applied to circuit segment $46_1$. At this time, the output signal of inverter circuit 45 is also applied to common electrode 47, and an AC voltage as shown in FIG. 4(*g*) exists between circuit segment 46, and common electrode 47. As a result, segment $46_1$, as shown in Table 2, activates display segments 2, 14, 18, 26, 29 and 36 in FIG. 2. Similarly, when output terminals $S_2$, $S_3$, $S_8$, $S_9$ and $S_{18}$ of decoder circuit 42 indicate "1," an AC signal as shown in FIG. 4(*g*) exists between the segments corresponding to these output terminals and common electrode 47 and each of these display segments is activated. When the output terminal $S_4$ of decoder circuit 42 is in phase with the output signal of inverter circuit 45, as shown in FIG. 4(*i*), and is applied to circuit segment $46_4$, since the output signal of inverter circuit 45 is also applied to common electrode 47, no potential difference is produced between circuit segment $46_4$ and common electrode 47 as shown in FIG. 4(*j*). As a result, the display segments 9, 10, 11, 12, 13 and 28 corresponding to circuit segment $46_4$ in Table 2 are not activated. Similarly, since output terminals $0_1$, $0_2$, $0_4$ and $0_8$ of the main control indicate (0001), the output terminals $S_5$, $S_6$, $S_7$, $S_{10}$, $S_{11}$, $S_{12}$, $S_{13}$, $S_{14}$, $S_{15}$, $S_{16}$ and $S_{17}$ of decoder circuit 42 are also zero volt signals as shown in FIG. 4(*h*), and the display segments corresponding to these output terminals are not activated. Accordingly, the display schematic at this time appears as shown in FIG. 6 and indicates that copying machine C is in a standby condition (unable to copy). At this time, main control 41 displays the number of copies, "0," on the numeral display 38.

Figure 7:
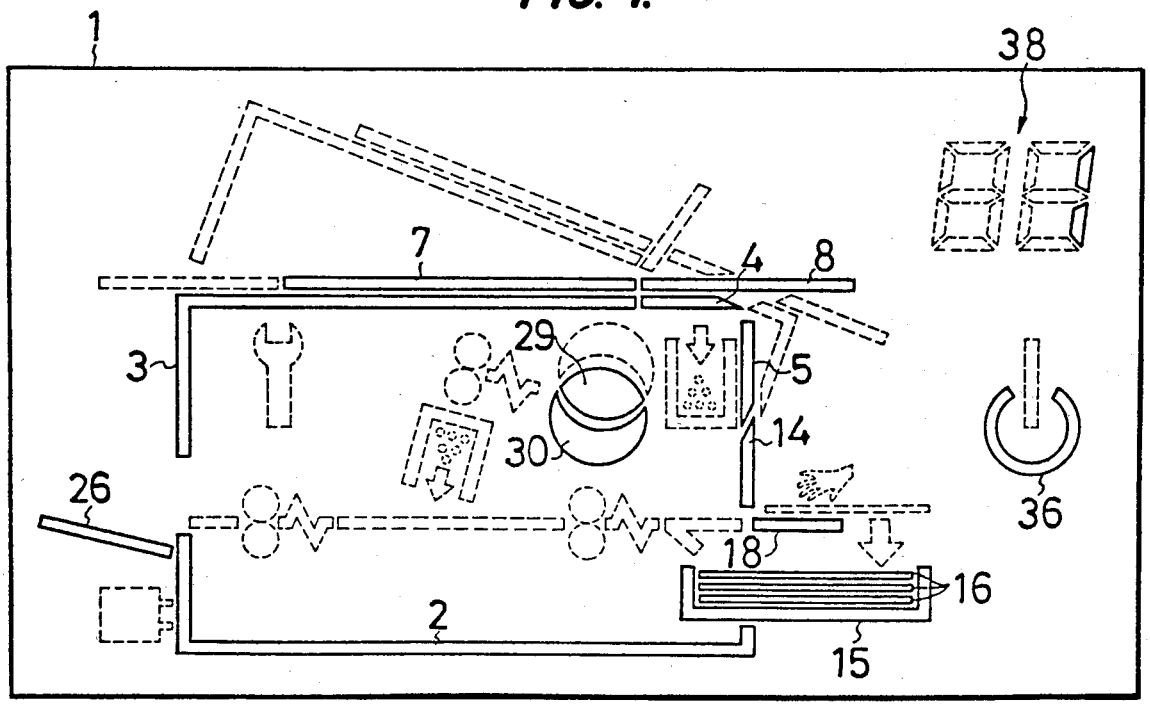
FIG. 7 shows the condition of the display device of FIG. 2 when the machine is ready to copy.

When the operating temperature of the fusing heater is attained and copying machine C becomes able to copy at time $t_1$ in FIG. 4, main control 41 outputs a code signal "2" (binary 0010) from output terminals $0_1$, $0_2$, $0_4$ and $0_8$. When this is decoded, output terminals $S_1$ to $S_{18}$ of decoder circuit 42 become (111000011000000000), the only difference from the standby condition being that terminal $S_{18}$ is at level "0" rather than level 1. As a result, the voltage applied to circuit segment $46_{18}$ is in phase with the output of inverter 45, display segment 37 in FIG. 2 does not light, and a ready condition (able to copy) is displayed as shown in FIG. 7. At this time, main control 41 displays the number "1" on numeral display 38.

Figure 8:
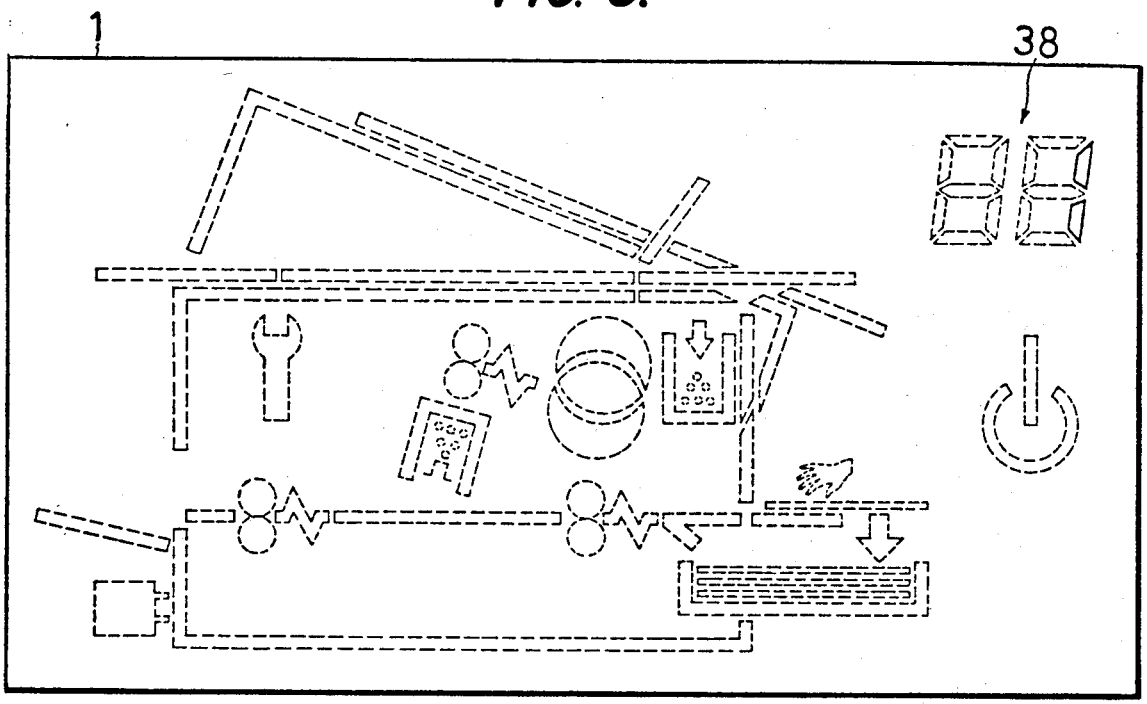
FIG. 8 shows the condition of the display device of FIG. 2 while the machine is copying.

As shown in FIG. 5, during a copying operation, main control 41 outputs a specific code signal, for example, signal "0" (binary 0000), indicating that the machine is in the process of copying. Accordingly, all output signal $S_1$ to $S_{18}$ of decoder circuit 42 become "0" as shown in Table 1. As a result, a zero volt signal is applied between each of segments $46_1$ through $46_{18}$ and common electrode 47, and all display segments 2 through 37, are deactivated. In this case, as shown in FIG. 8, the display is blank except for a numeral in part 38. This shows that the copying machine is copying.

Figure 9:
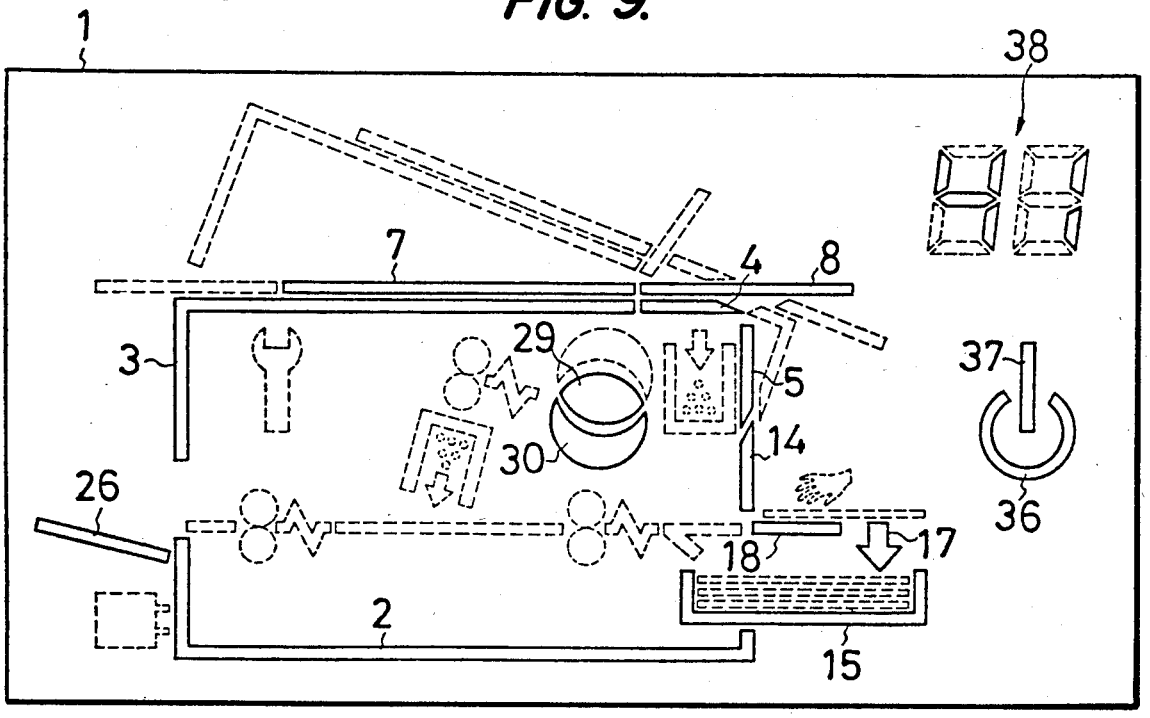
FIG. 9 shows the condition of the display device of FIG. 2 when it is necessary for the operator to add copying paper.

At time $t_2$ during copying, when the absence of copying paper in paper feed cassette 52 is detected by a detector (not shown), main control 41 stops the operation of copying macine C according to the program and simultaneously outputs a code signal showing "absence of copying paper," signal "3" (binary 0011). When this signal is decoded, the output terminals $S_1$ to $S_{18}$ of the decoder circuit become (111000010100000001) as shown in Table 1. As a result, an AC signal is applied only between circuit segments $46_1$, $46_3$, $46_8$, $46_{10}$, $46_{18}$ and common electrode 47 and thus display segments 2, 3, 4, 5, 7, 8, 14, 15, 17, 18, 26, 29, 30, 36 and 37 corresponding to these circuit segments are activated and other segments are not. Accordingly, the display in this case is as shown in FIG. 9 and indicates the absence of copying paper in copying macine C. In FIG. 9, the number "41" in the numeral display shows that copying paper ran out after 41 sheets had been copied. In this case, display segment 17, indicating the absence of copying paper, can be made more conspicuous by flickering instead of lighting continuously.

Figure 10:
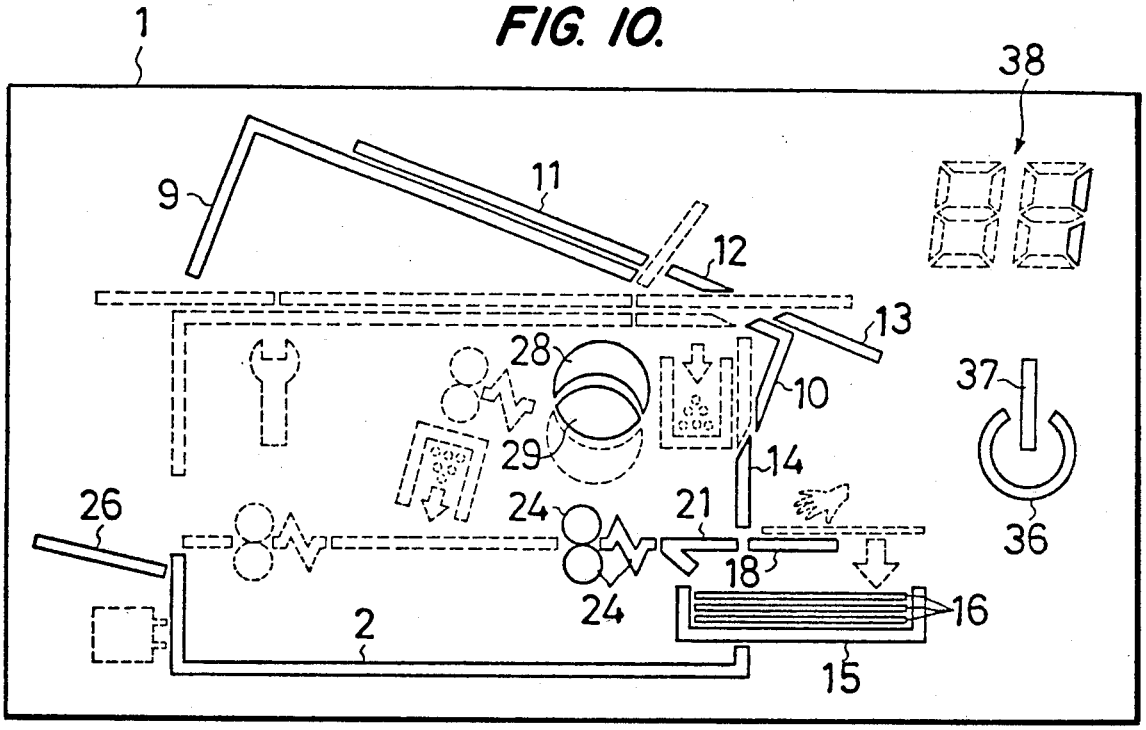
FIG. 10 shows the condition of the display device of FIG. 2 when there is a paper jam in the paper supply path.

Although for this condition the timing chart is not illustrated, when jamming of copying paper occurs in the paper supply path and is detected by a detector (not shown), main control 41 stops the operation of the copying machine and simultaneously outputs a code signal showing "paper jamming the supply path," signal "9" (binary 1001). When this is decoded, the output terminals $S_1$ to $S_{18}$ of decoder circuit 42 become (100110011000000001) as shown in Table 1. As a result, an AC signal is applied between circuit segments $46_1$, $46_4$, $46_5$, $46_8$, $46_9$ and $46_{18}$ and common electrode 47, display segments 2, 9, 10, 11, 16, 18, 21, 24, 26, 28, 29, 36 and 37 are activated, and the other segments are not. Accordingly, "paper jamming the supply path" is displayed as shown in FIG. 10. Although FIGS. 6 through 9 showed the upper cover 56 of copying machine C closed, in FIG. 10 upper cover 56 of copying machine C is displayed opened, by way of instruction to the operator. FIG. 10 shows that paper jamming occurred when one sheet of copying paper was copied since "1" is displayed on numeral display 38. In this case also, paper jamming can be displayed more conspicuously by flickering segment 24.

Figure 11:
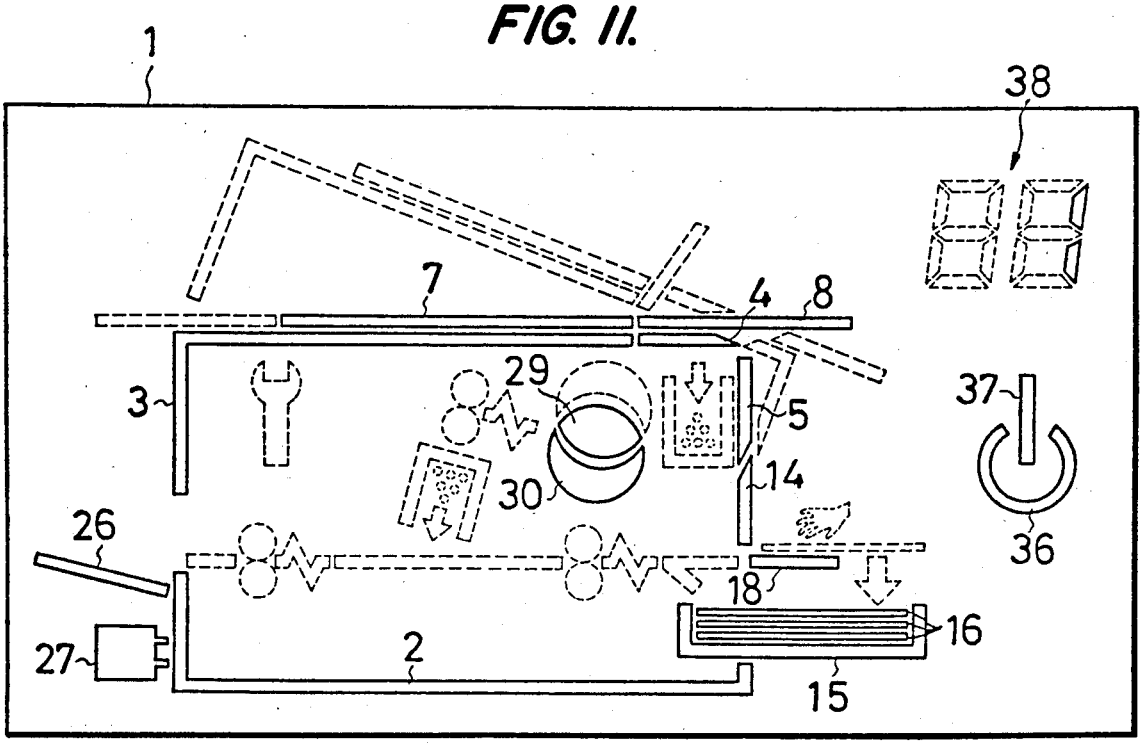
FIG. 11 shows the condition of the display device of FIG. 2 when it is necessary for the operator to insert a key counter.
Figure 12:
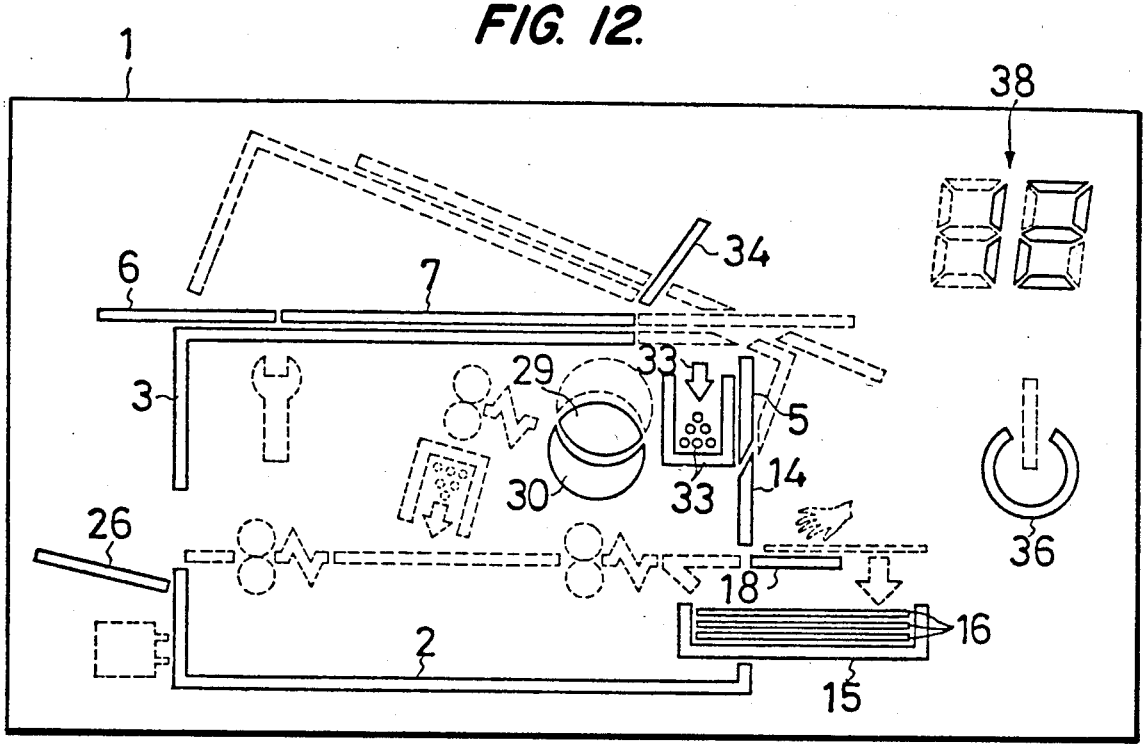
FIG. 12 shows the condition of the display device of FIG. 2 when it is necessary for the operator to add toner.
Figure 13:
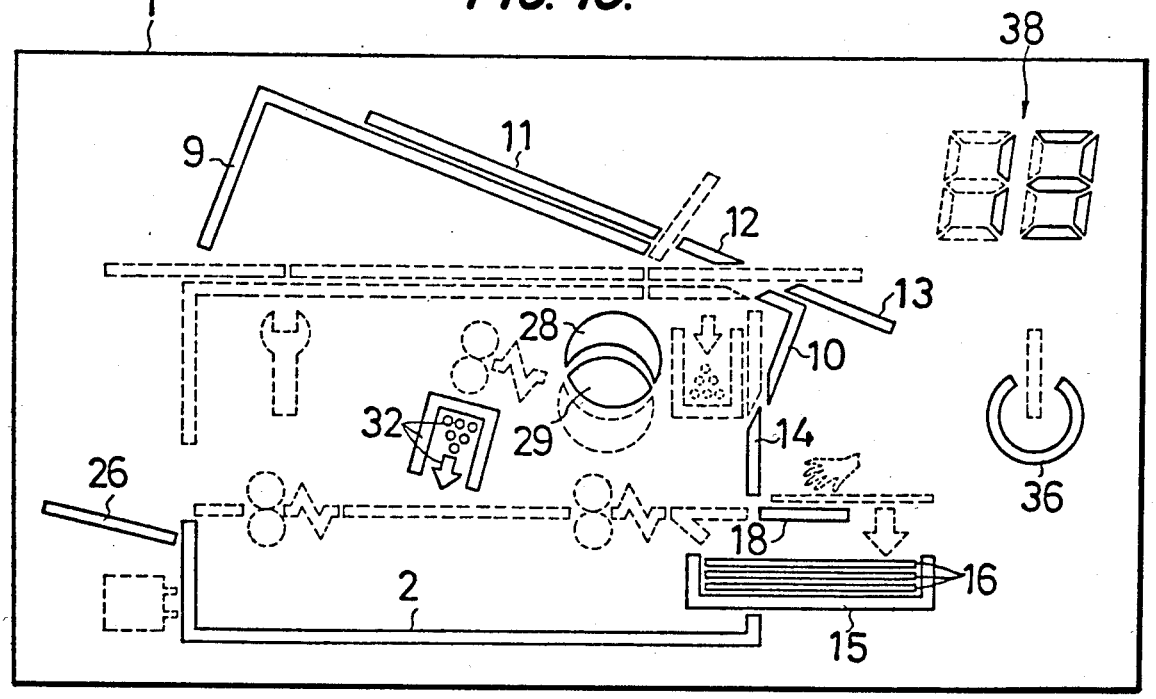
FIG. 13 shows the condition of the display device of FIG. 2 when it is necessary for the operator to empty the recovered toner storage bin.
Figure 14:
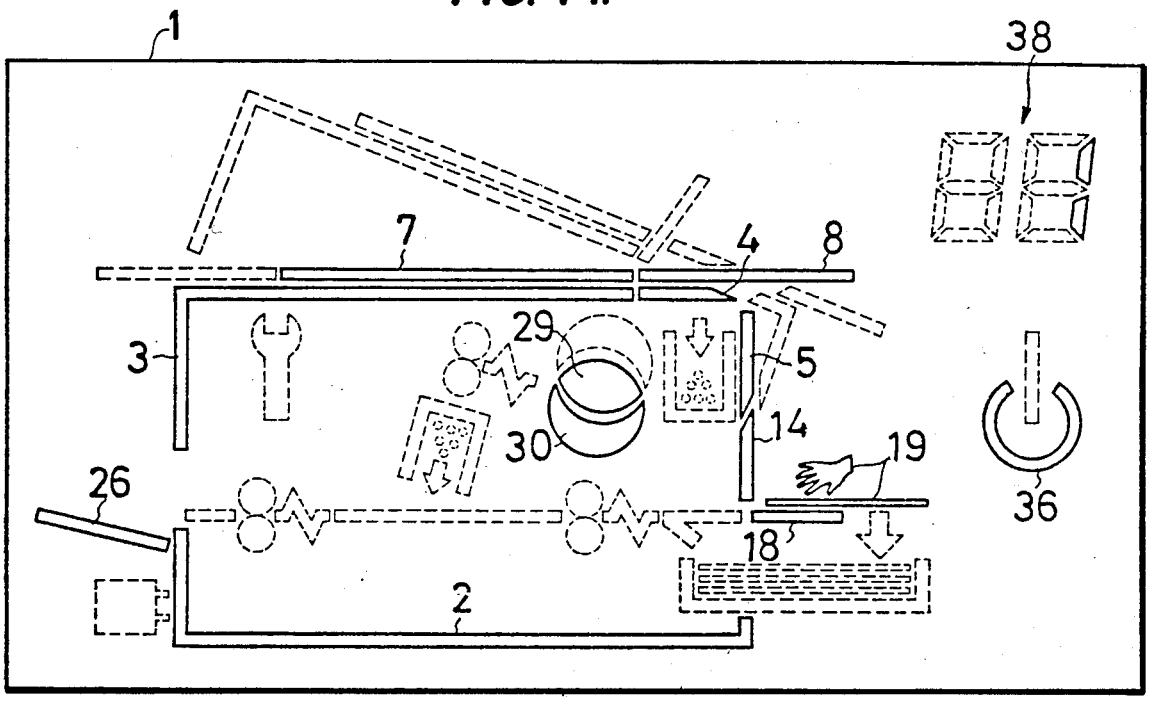
FIG. 14 shows the condition of the display device of FIG. 2 when the machine is in the manual paper feed mode.
Figure 15:
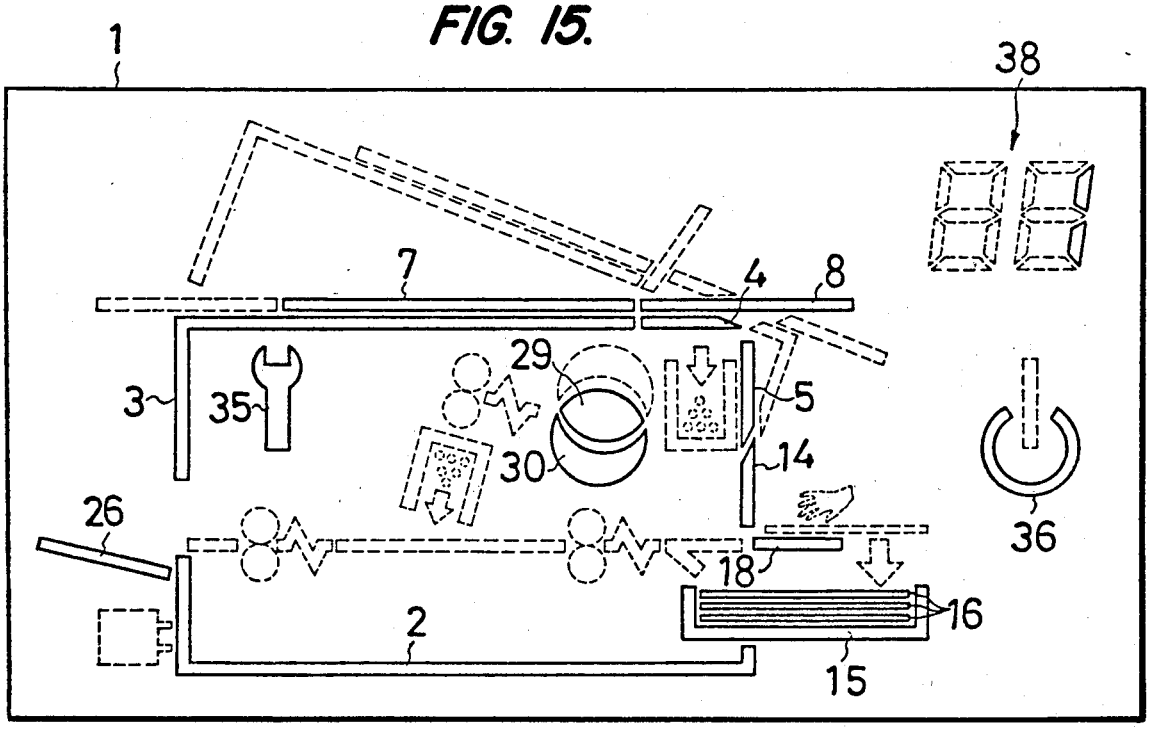
FIG. 15 shows the condition of the display device of FIG. 2 when the machine is scheduled for a periodical inspection.
Figure 16:
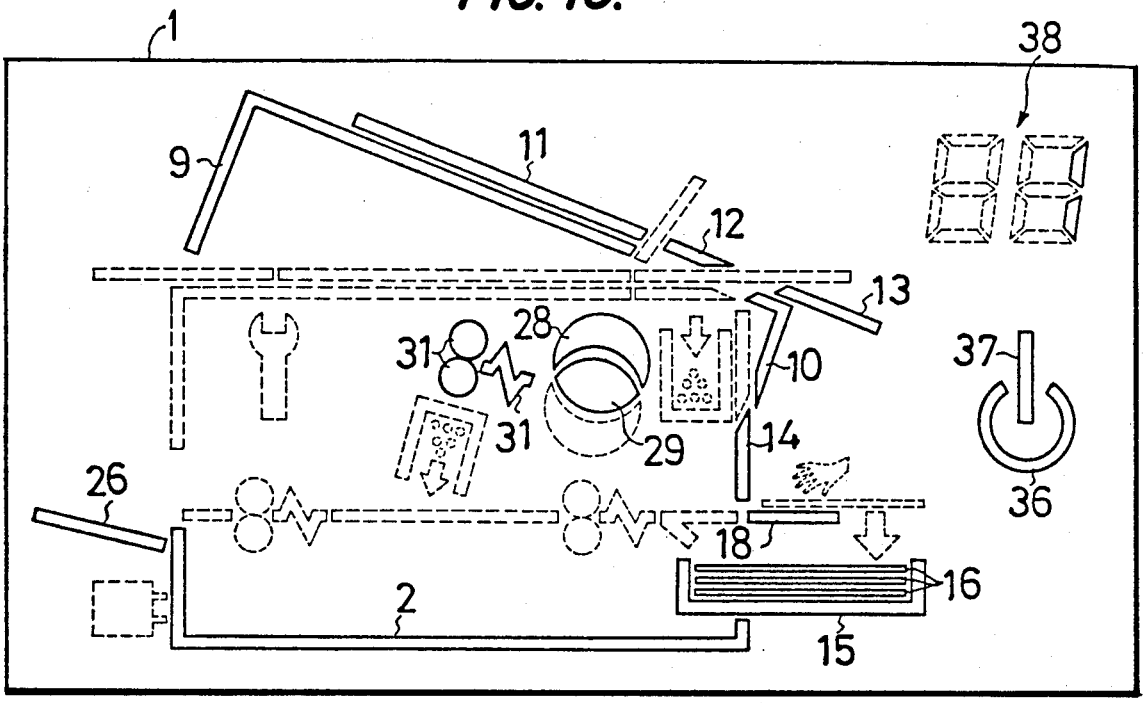
FIG. 16 shows the condition of the display device of FIG. 2 when paper is separating from the photosensitive drum.
Figure 17:
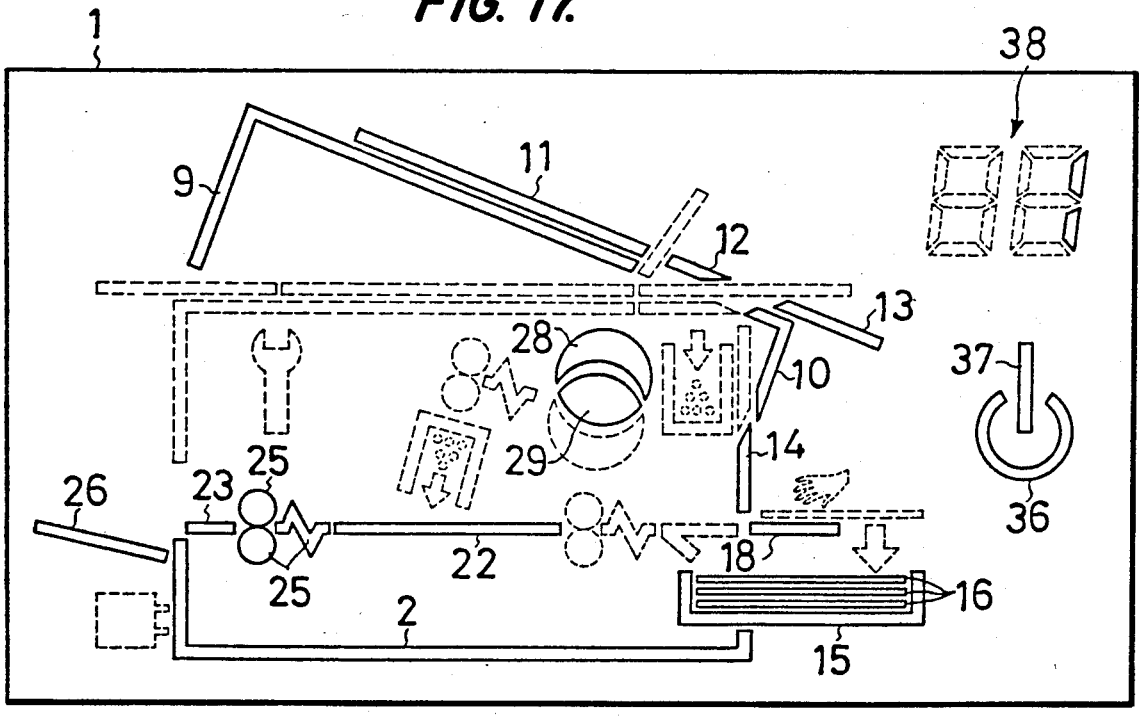
FIG. 17 shows the condition of the display device of FIG. 2 when there is a paper jam in the fuser or paper exit path.

In the same manner as mentioned above, each condition is displayed schematically according to the relation between the input and the output of decoder 42 as shown in Table 1. For example, the display shown in FIG. 11 occurs when a key counter is not inserted into copying machine C. In this case, the indication to insert the key counter (display segment 27) and the standby condition (display segments 36 and 37) are displayed. Further, when toner in the toner hopper runs out, the display appears as shown in FIG. 12. The condition where "no toner" is present is displayed by display segment 33, while the operator is instructed by display segment 34 to open top cover 59 for the toner hopper. When the recovered-toner storage bin is filled with recovered toner, the display appears as shown in FIG. 13. Display segments 9, 10, 11, 12, 13 and 29 are activated, instructing the operator to open upper cover 56 of copying machine C. The recovered-toner storage bin itself is displayed schematically by display segment 32. In the manual paper feed mode, the display appears as shown in FIG. 14 and the "manual paper feed" condition is displayed by display segment 19. When a periodical inspection is required to be performed, the display appears as shown in FIG. 15 and the condition of the "periodical inspection" is displayed schematically by display segment 35. When paper separation from the photosensitive drum occurs, the display appears as shown in FIG. 16, the separation error is displayed by display segments 30 and 31, and the standby condition is displayed schematically by display segments 36 and 37. When paper jamming occurs in the fuser or paper exit path, the display appears as shown in FIG. 17, and the paper jamming condition is displayed schematically by display segments 22, 23 and 25. In FIGS. 16 and 17, display segments 9, 10, 11, 12, 13, 28 and 29 are activated to instruct the operator to open upper cover 56 of copying machine C. Further, it is acceptable to flicker display segments 27, 33, 32, 19, 35, 31 and 25 for indicating these conditions.

By means of this display device, each condition of the copying machine can be displayed accurately; and when trouble such as paper jamming occurs, the method of removing jammed paper can be indicated to the operator by displaying the figure of the upper cover in an opened condition, if it is necessary to open it. In this way, the operator becomes more familiar with the machine, the displays are more correct and clear, and more kinds of conditions, with appropriate instructions to the operator, can be displayed.

In the embodiment mentioned above, explanation is given regarding the case where a liquid crystal display element is used in the display segments. However, even when other luminous elements, such as light emitting diodes, are used, the same effect can be obtained by combining them with a driving means.

Although illustrative embodiments of the invention have been described in detail with reference to the accompanying drawings, it is to be understood that the invention is not limited to those precise embodiments and that various changes and modifications may be effected therein by one skilled in the art without departing from the scope and spirit of the invention.

We claim:

1. A machine (C) comprising:

an outer casing including at least one casing part (56, 59) which is movable to provide access to the interior of said casing;

a plurality of operating parts within said casing, each of said operating parts being susceptible of malfunction; and a display device (1) outside said casing, said display device comprising:

(i) a first group of display segments (14, 24, 25) formed to schematically represent corresponding ones of said operating parts;

(ii) a second group of display segments (9, 10, 34) formed to schematically represent said at least one movable casing part; and (iii) display control means (41, 42) coupled to said first group of display segments, said second group of display segments and said operating parts for activating a segment of said first group in response to a malfunction of the corresponding operating part and for activating segments of said second group in response to a malfunction of selected ones of said operating parts requiring said at least one movable casing part to be moved to provide access to said malfunctioning operating part.

2. A machine as claimed in claim 1 wherein said machine is an electrophotographic copying machine having a photosensitive member as one of said operating parts, and said at least one movable casing part comprises an upper cover movable between a closed position and an open position to provide access to said photosensitive member when said upper cover is in the open position.

3. A machine as claimed in claim 1 wherein said first and second groups of display segments are liquid crystal display elements.

4. A machine as claimed in claim 2 wherein said display control means does not activate said first group of display segments while said machine is in operation.

5. A machine as claimed in claim 2 wherein said display control means activates said display segments of said second group representing said upper cover whenever said display segments of said first group representing said photosensitive member are activated.

6. A machine as claimed in claim 2 further comprising a toner hopper as one of said operating parts, said outer casing further comprising, as a movable part, a top cover movable between a closed position and an open position to provide access to said toner hopper.

* * * * *